US005481759A

United States Patent [19]

Rinaldi

[11] Patent Number: 5,481,759

[45] Date of Patent: Jan. 9, 1996

[54] EXPANDABLE BASEBALL HAT AND COVER

[76] Inventor: Robert Rinaldi, 139 S. Ridgedale Ave., E. Hanover, N.J. 07937

[21] Appl. No.: 161,924

[22] Filed: Dec. 3, 1993

[51] Int. Cl.[6] ..... A42B 1/00

[52] U.S. Cl. ..... 2/195.1; 2/171.1; 2/181; 2/195.2; 2/195.5; 2/209.13; 2/425

[58] Field of Search ..... 2/10, 171, 171.1, 2/175.1, 181, 181.4, 182.4, 182.2, 195.1, 195.2, 195.3, 195.4, 195.5, 200.1, 209.11, 209.12, 209.13, 410, 411, 412, 413, 414, 417, 418, 419, 420, 425

[56] References Cited

U.S. PATENT DOCUMENTS

| | | | |
|---|---|---|---|
| 2,391,335 | 12/1945 | O'Brien . | |
| 4,996,724 | 3/1991 | Dextrase . | |
| 5,088,129 | 2/1992 | Kamata . | |
| 5,099,524 | 3/1992 | Linday . | |
| 5,119,514 | 6/1992 | Woehl | 2/195.2 |
| 5,136,726 | 8/1992 | Kellin et al. | 2/171 |
| 5,177,810 | 1/1993 | Minton et al. . | |
| 5,226,180 | 7/1993 | Leach . | |
| 5,253,368 | 10/1993 | Blake | 2/195.1 |
| 5,289,591 | 3/1994 | Andersen | 2/425 |

OTHER PUBLICATIONS

Giro 1994 Products Brochure, 1994. The Basebowl Helmet.
Undercover Sports, Inc., The Hat Sports Helmet.

*Primary Examiner*—Diana Biefeld

*Attorney, Agent, or Firm*—Weingram & Zall

[57] ABSTRACT

An expandable baseball hat and cover adapted to expand and conform to differently shaped heads or protective devices. The hat includes a first flexible material which has an inner surface, an outer surface and a peripheral edge to form a skirt portion. The inner surface of the first material is provided with two tab members, each of which has coacting fastening means for releasable engagement with each other. The tab elements are engaged to gather the flexible material for a snug, conformed fit to the wearer's head. The expandable hat can be used in combination with a rigid shell, such as a batting helmet. The expandable hat is fitted over the shell for the skirt to snugly engage the peripheral edge of the shell without other fastening means. The skirt and inner surface of the shell are provided with second coacting fastening means in registration for releasable engagement. If a substantial amount of skirt is unused, the second coacting fastening means can be engaged to move the skirt material away from the wearer's forehead. The rigid shell is also provided with at least one aperture therethrough for receiving a corresponding number of engagement members of a rigid bill/visor for removable mounting to the shell.

23 Claims, 2 Drawing Sheets

EXPANDABLE BASEBALL HAT AND COVER

BACKGROUND OF THE INVENTION

FIELD OF THE INVENTION

The present invention relates to head coverings and protectors which are removably mountable to conform to safety helmets for the head.

BACKGROUND OF THE INVENTION

In many activities, including sports such as baseball, bicycle riding, skate boarding, roller blading, etc., the activity requires the participant to wear some form of helmet or head covering to protect the head against trauma from flying objects or falls. Very often, the exterior of the head protector should bear indicia, such as team logos, etc. and also a sun shade to shield the wearer's eyes.

DESCRIPTION OF THE PRIOR ART

There are many types of protective headgear that have been developed in the past.

For example, U.S. Pat. No. 2,391,335 to O'Brien, discloses a head protector consisting of a stiff fabric protective shell covered at its exterior by a finishing fabric to improve the appearance of the shell. There is disclosure that the finishing fabric is secured to a sweatband by stitching inside the shell. A peak or eye shield is adapted to be removably secured to the shell by forming the shell with threaded holes and the peaks with fingers having holes therethrough. The fingers are received in the shell holes whereupon screws are employed to hold the fingers in the shell holes. Alternatively, the shell may be positioned inside a conventional baseball cap with the sweatband section of the cap glued or otherwise secured to the shell.

U.S. Pat. No. 4,996,724 to Dextrase, discloses a safety helmet consisting of a top dome portion and a bottom rim portion, both of which are formed from impact resistant material, and a shock-absorbent inner liner in intimate engagement with the top dome portion.

U.S. Pat. No. 5,088,129 to Kamata, discloses a jet-type helmet consisting of a hard outer shell and a buffer liner which is closely fitted to an inner surface of the shell. A shield plate at the front of the shell is turnable between a closing position and an opening position.

U.S. Pat. No. 5,099,524 to Linday, discloses a segmented cap assembly consisting of a crown component, a visor component and a sweatband component, each of the components being detachably connectable to each other and which can be used for display of printed matter at the forehead portion of each component. Hook and loop type material, such as that under the trademark VELCRO, is used to detachably connect the components to each other. The crown component is formed from a flaccid material. The visor component consists of an integrally-formed bill portion and forehead portion which are preferably formed from a plastic material of moderate stiffness. The printed matter can be a company logo, trademark or tradename.

U.S. Pat. No. 5,177,810 to Minton et al., discloses a sun shield for infants consisting of a cap, a flexible transparent shield removably affixed to a surface of the cap, and a binding material. The binding material surrounds the outer periphery of the shield to conceal any exposed edges of the shield.

U.S. Pat. No. 5,226,180 to Leach, discloses a protective head piece consisting of a hemispherically-shaped shell formed with a plurality of openings for ventilation, and an outer cover preferably of a fabric and having the appearance of a conventional ball cap with a bill. The outer cover is of a size and shape so as to correspond to the exterior configuration of the shell and may be removably attached to the shell by using, for example, rubber cement. The shell is formed from a rigid foamed material.

However, none of the foregoing inventions disclose a flexible cover or hat having cinching means disposed at an interior surface of the hat to gather the hat material to more closely adhere to the shape of the wearer's head. None of the foregoing inventions disclose a combination flexible hat and rigid shell, wherein the hat is removably mountable to the underlying shell and securely positioned without using mechanical or chemical fastening means to implement this combination.

SUMMARY OF THE INVENTION

An expandable baseball hat and cover of the present invention is adapted to expand and conform to the wearer's head or protective devices for the head, and includes a first flexible material to fit the wearer's head, the first flexible material having a front portion, a rear portion, a first inner surface which includes first and second tab members, the first and second tab members having coacting fastening means being disposed at the rear portion at the first inner surface for releasable engagement with each other to gather the first flexible material, a first outer surface, and a peripheral edge forming a skirt, the skirt having fastening means disposed thereon at the front portion; and a second flexible material having a second inner surface and a second outer surface, wherein the second inner surface of the second flexible material is secured to the first outer surface of the first flexible material at the front portion, the skirt releasably securing the first flexible material to the wearer's head, and the coacting fastening means of the first and second tab members being engaged to gather the first flexible material to snugly conform to the wearer's head, and a visor portion.

It is an object of the present invention to provide an expandable baseball hat and cover which is formed from two different types of material to facilitate placement and mounting of the hat on the wearer's head.

It is another object of the present invention to provide an expandable baseball hat which is adaptable to accommodate heads having different shapes.

It is a further object of the present invention to provide a baseball hat which is formed to be removably mounted to the exterior of a rigid shell or safety helmet for placement on the crown of the wearer's head.

It is a further object of the present invention to provide an expandable baseball hat having a flexible skirt extending along a peripheral edge of the hat, which flexible skirt securely holds the expandable hat comfortably to a wearer's head.

It is a further object of the present invention to provide an expandable baseball hat having a flexible skirt with an elasticity sufficient to maintain the hat at a selected position over the rigid shell.

It is a further object of the present invention to provide coacting fastening means disposed at the flexible skirt and rigid shell, the coacting fastening means being in registration with each other to facilitate mounting of the expandable hat to the rigid shell.

It is a further object of the present invention to provide an expandable baseball hat which is provided with cinching means to gather material that forms the expandable hat so that the hat conforms closely to the wearer's head.

It is a further object of the present invention to provide the cinching means at the inside of the expandable cover so that the exterior surface of the cover has a smooth uniform appearance.

It is a further object of the present invention to provide an expandable baseball hat which is comfortable to wear and maintains its position on the wearer's head.

It is a further object of the present invention to provide an expandable baseball hat which is comfortable to wear whether the hat is worn in the conventional manner with the bill/visor shading the eyes or with the bill/visor shading the nape of the wearer's neck.

It is a further object of the present invention to provide a hat device to cover helmets for sports, such as a baseball and/or other activities such as bicycle riding.

BRIEF DESCRIPTION OF THE DRAWINGS

For a more complete understanding of the present invention, reference may be had to the following description of an exemplary embodiment of the present invention considered in connection with the accompanying drawings, in which.

DETAILED DESCRIPTION

Figure 1:
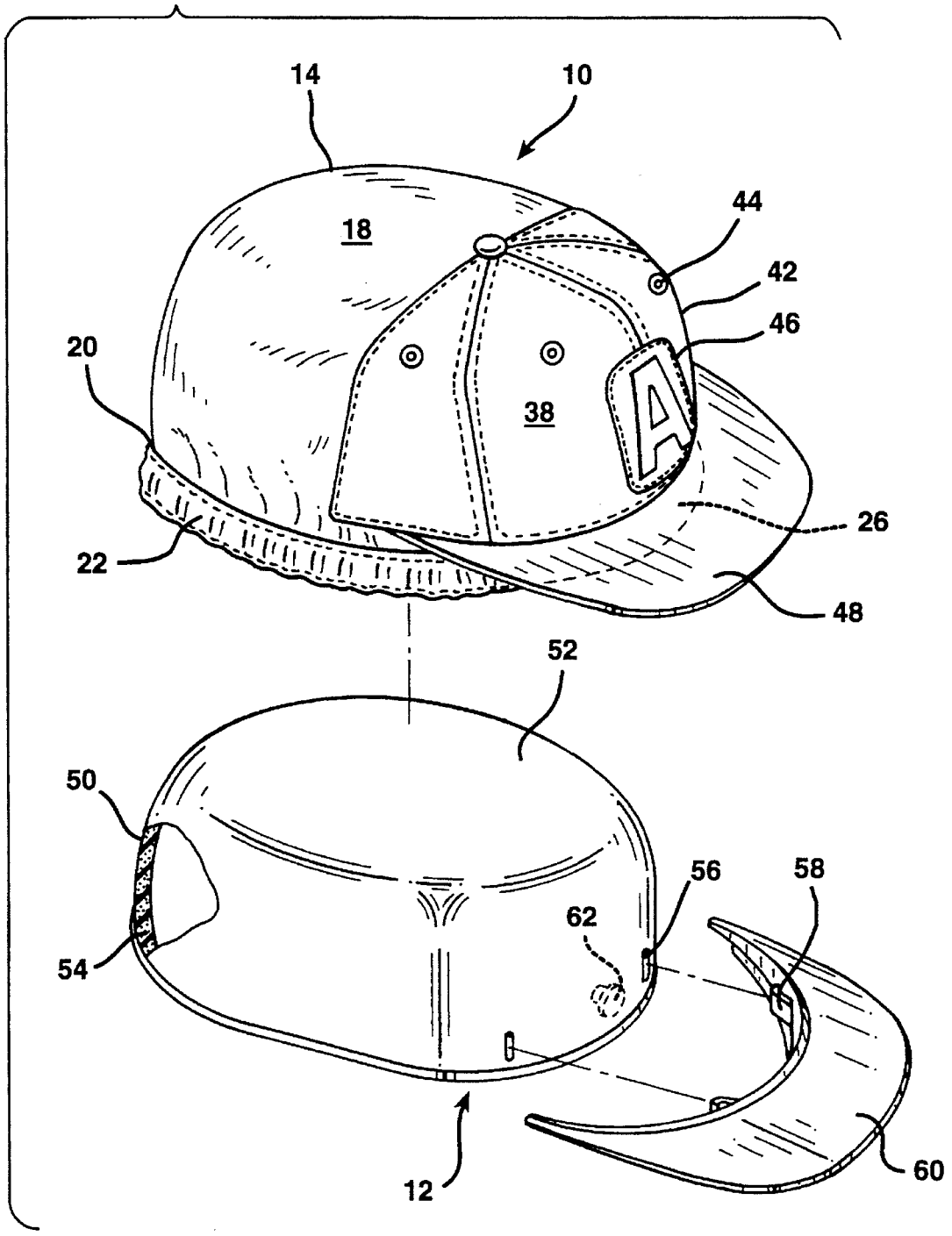
FIG. 1 is a front left perspective view showing an expandable hat and rigid shell with a removably mountable visor of the present invention.

Referring to FIG. 1, there is shown an expandable hat 10 which can be worn alone on the head or in combination with a rigid shell 12 for protective purposes.

Figure 2:
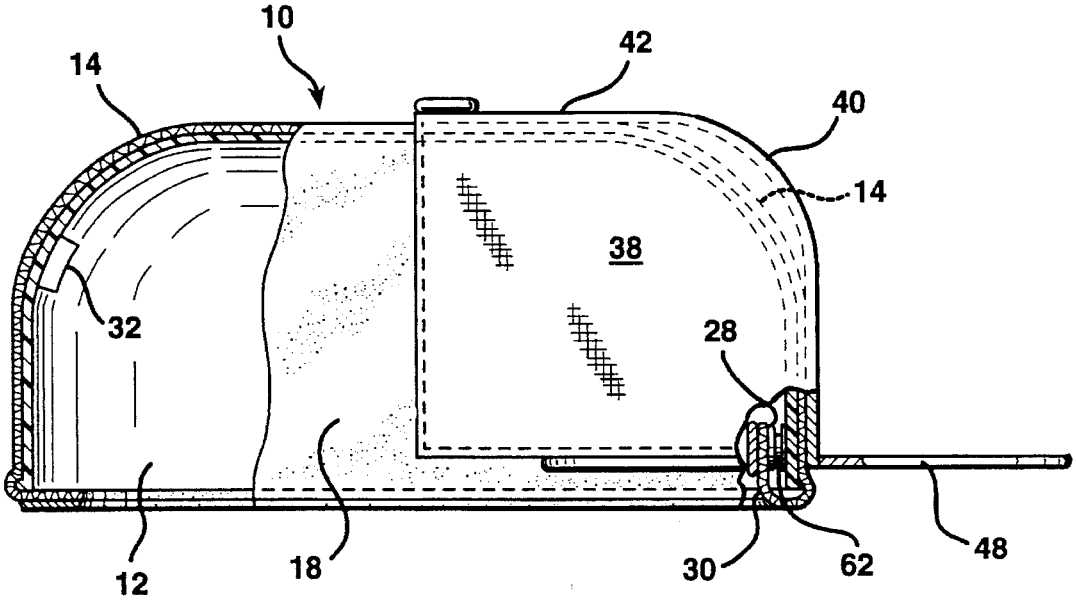
FIG. 2 is a side view showing the expandable cover removably mounted to the rigid shell of the present invention.
Figure 3:
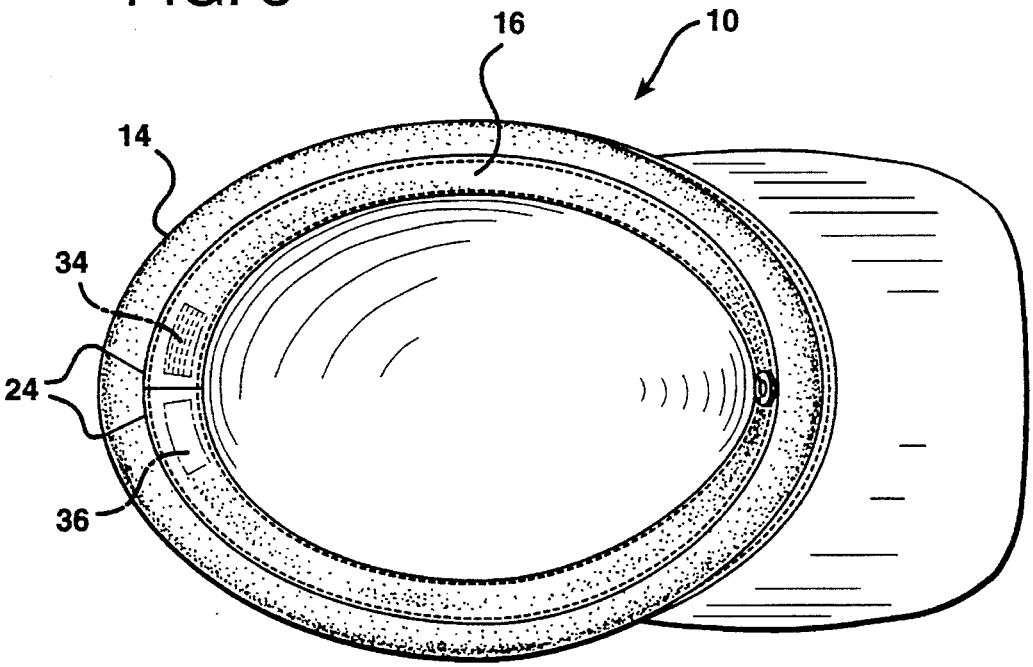
FIG. 3 is a bottom view showing the expandable cover of the present invention.

Referring additionally to FIGS. 2 and 3, the expandable hat includes an elastic head covering portion 14, which is extremely flexible and readily adaptable to fit the wearer's head. The elastic portion 14 is made from a SPANDEX or stocking-like material. The elastic portion has an inner surface 16, an outer surface 18 and a peripheral edge 20 which are all similarly elastic. The peripheral edge 20 extends for forming a skirt 22. A rearward area of the elastic portion 14 is formed with a V-seam 24 to gather some of the material of the elastic portion so that the elastic is stretched over the head for a snug fit. A forward portion 26 of the skirt 22 contacts the forehead and is provided with a mechanical fastener 28, such as a snap fastener. The fastener 28 is secured directly to the skirt or by a band 30 of flexible material. The purpose of the snap fastener will be described hereafter.

The inner surface 16 at the rearward area of the elastic portion 14 also includes means 32 to cinch and gather and secure the elastic portion about the wearer's head. This gives the outer surface 18 of the elastic portion a smooth and uniform appearance. The cinching means includes two flexible bands or tabs 34, 36, each having one of their ends secured by stitching, gluing, etc., to the inner surface of the elastic portion. One of the tabs is provided with one of a hook-and-pile type material, while the other tab is provided with another of the hook-and-pile type material. The coacting elements of the hook-and-pile type materials are disposed along their respective tabs to be in registration with one another for engagement when it is desired that excess material of the elastic portion is to be gathered, such as when the wearer's head is too small for the expandable hat. Use of the hook-and-pile type material, such as that distributed under the trademark VELCRO, is advantageous for gathering the elastic portion to accommodate differently shaped heads. Hook-and-pile type material is also preferred for the wearer's comfort. The cinching means is disposed at the inner surface 16 of the elastic material for aesthetic purposes.

The expandable hat 10 includes a flexible material portion 38 made from a stiff fabric or cloth, and which has inner 40 and outer 42 surfaces. The material of the flexible portion is not as flexible or elastic as the elastic portion 14. The inner surface 40 is affixed by stitching to the outer surface 18 of the elastic material at the front of the hat. The flexible portion includes vent holes 44 and covers a forward portion of the hat. The stiffer material of the flexible portion provides support to the underlying elastic portion 14 so that the hat "stands up" at the forward crowned area of the wearer's head. This is preferable to give the hat structure and to provide more substantial support and visibility for printed or sewn indicia 46, such as a team insignia, corporate sponsor, design or the like. A bill or visor 48 is stitched to the material portion 38 at the forward area of the skirt to shade the wearer's eyes or neck, depending how the hat is positioned on the head.

The elastic portion 14 and expandable skirt 22 enable the wearer to position the hat for the bill to shade the eyes or be rotated to shade the nape of the neck.

The rigid shell 12 covers and protects the wearer's head during activities that require such protection. The shell has an interior surface 50 and exterior surface 52.

The interior surface 50 is provided with cushionable material such as padding and/or insulation 54 of foam, rubber or the like. A forward portion of the shell is provided with at least one, and preferably two apertures 56 for receiving securing members 58 of a rigid bill 60 or visor. The coaction between the aperture(s) 56 and member(s) permits the bill to be removably mounted to the front of the shell. The interior surface 50 of the front portion of the shell which coacts with the bill is also provided with a mechanical fastener 62, such as a snap fastener, to coact with the mechanical fastener 28 at the skirt.

To use the expandable hat of the present invention, the wearer can select to cover his head with the elastic hat portion only. If the wearer requires the hat to fit more snugly, the VELCRO tabs 34, 36 are brought into engagement with each other to cinch-up and gather the elastic material.

Alternatively, the user can removably mount the elastic portion 14 to the rigid shell 12, such as a batting helmet or a large styrofoam bicycle helmet, and then position the rigid shell on his or her head. The elasticity of the skirt 22 will securely hold the cover to the shell at a selected position. That portion of the skirt toward the front of the cover can be moved off the forehead by engaging the snap closures 28, 62.

The expandable hat of the present invention will find application in a wide variety of activities such as sports including, for example, baseball, horseback riding or bicycle riding. The removably mountable rigid bill provides sun shade protection for the wearer. However, it does not have to be used with the rigid shell because the flexible portion can be provided with a bill 48.

The expandable hat of the present invention is versatile in that an individual can select a rigid shell that is formed to comfortably fit the head, and then select or interchange expandable portions which have the desired indicia thereon.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

What is claimed is:

1. A combination expandable hat and rigid shell comprising:

a first flexible material to fit a wearer's head, said first flexible material having:

a front portion, a rear portion, a first inner surface which includes first and second tab members, said first and second tab members having coacting fastening means and being disposed at said rear portion of said first inner surface for releasable engagement with each other, a first outer surface, and a peripheral edge forming a skirt, said skirt having first fastening means disposed thereon at said front portion; and a second flexible material having:

a second inner surface and a second outer surface, wherein said second inner surface of said second flexible material is secured to said first outer surface of said first flexible material at said front portion, said skirt releasably securing said first flexible material to the wearer's head, and said coacting fastening means of said first and second tab members being engaged to gather said first flexible material to snugly conform to the wearer's head, a visor portion; and a shell to be positioned on the wearer's head, said shell having:

a front portion, a rear portion, an inner surface, said inner surface having second fastening means disposed thereon at said shell front portion in registration with said first fastening means of said skirt for releasable engagement thereto, an outer surface for receiving said first inner surface of said first flexible material, a peripheral edge, and at least one aperture extending through said shell front portion;

wherein said first flexible material is disposed over said shell and retained thereto by said flexible skirt of said first flexible material being snugly engaged to said shell peripheral edge.

2. The combination expandable hat and rigid shell according to claim 1, wherein said first flexible material is of greater elasticity than said second flexible material.

3. The combination expandable hat and rigid shell according to claim 1, wherein said second flexible material provides support and structure for said first flexible material.

4. The combination expandable hat and rigid shell according to claim 1, wherein said second flexible material includes holes for ventilation.

5. The combination expandable hat and rigid shell according to claim 1, wherein said second outer surface of said second flexible material is adapted to receive indicia thereon.

6. The combination expandable hat and rigid shell according to claim 1, wherein said first fastening means is a snap closure and said second fastening means is a coacting snap closure.

7. The combination expandable hat and rigid shell according to claim 1, further including cushionable material disposed at said shell inner surface.

8. The combination expandable hat and rigid shell according to claim 1, further including a visor having at least one securing member extending therefrom for removable engagement with said at least one aperture at said front portion of said shell.

9. The combination expandable hat and rigid shell according to claim 8, wherein said visor is formed of a rigid material.

10. The combination expandable hat and rigid shell according to claim 1, wherein said coacting fastening means is hook and pile type material.

11. An expandable hat comprising:

a first flexible material to fit a wearer's head, said first flexible material having:

a front portion, a rear portion, a first inner surface which includes first and second tab members, said first and second tab members having coacting fastening means and being disposed at said rear portion of said first inner surface for releasable engagement with each other to gather said first flexible material, a first outer surface, and a peripheral edge forming a skirt, said skirt having fastening means disposed thereon at said front portion; and a second flexible material having:

holes for ventilation, a second inner surface, a second outer surface, wherein said second inner surface of said second flexible material is secured to said first outer surface of said first flexible material at said front portion, said skirt releasably securing said first flexible material to the wearer's head, and said coacting fastening means of said first and second tab members being engaged to gather said first flexible material to snugly conform to the wearer's head, and a visor portion.

12. The expandable hat according to claim 11, wherein said first flexible material is of greater elasticity than said second flexible material.

13. The expandable hat according to claim 11, wherein said second flexible material provides support and structure for said first flexible material.

14. The expandable hat according to claim 11, wherein said second outer surface of said second flexible material is adapted to receive indicia thereon.

15. The expandable hat according to claim 11, wherein said fastening means is a snap closure.

16. The expandable hat according to claim 11, wherein said coacting fastening means is hook and pile type material.

17. An expandable hat comprising:

a first flexible material to fit a wearer's head, said first flexible material having:

a front portion, a rear portion, a first inner surface which includes first and second tab members, said first tab member having first fastening means and said second tab member having second fastening means, said first and second tab members disposed at said rear portion of said first inner surface for said first and second fastening means to coact for releasable engagement with each other to gather said first flexible material, a first outer surface, and a peripheral edge forming a skirt, said skirt having third fastening means disposed thereon at said front portion for fastening said skirt to another object; and a second flexible material having:

a second inner surface, a second outer surface, vent holes extending through said second inner surface and said second outer surface, wherein said second inner surface of said second flexible material is secured to said first outer surface of said first flexible material at said front portion, said skirt releasably securing said first flexible material to the wearer's head, and said first fastening means of said first tab member and said second fastening means of said second tab member coacting for engagement with each other to gather said first flexible material to snugly conform to the wearer's head, and a visor portion.

18. The expandable hat according to claim 17, wherein said first flexible material is of greater elasticity than said second flexible material.

19. The expandable hat according to claim 17, wherein said second flexible material provides support and structure for said first flexible material.

20. The expandable hat according to claim 17, wherein said second outer surface of said second flexible material is adapted to receive indicia thereon.

21. The expandable hat according to claim 17, wherein said third fastening means is a snap closure.

22. The expandable hat according to claim 17, wherein said first fastening means is one of a hook and pile type material and said second fastening means is another of the hook and pile type material.

23. The expandable hat according to claim 17, wherein said third fastening means comprises:

a flexible band having a first end depending from said skirt and a second end opposed to said first end to extend toward said first inner surface; and a snap closure mounted to said second end for removably fastening said another object at said skirt near said first inner surface.

* * * * *